US006599261B1

(12) United States Patent
Chen

(10) Patent No.: US 6,599,261 B1
(45) Date of Patent: Jul. 29, 2003

(54) MASSAGING DEVICE

(75) Inventor: Yuan-Chuen Chen, Chang-Hua Hsien (TW)

(73) Assignee: Hsin Hao Health Materials Co., Ltd., Chang-Hua (TW)

( * ) Notice: Subject to any disclaimer, the term of this patent is extended or adjusted under 35 U.S.C. 154(b) by 0 days.

(21) Appl. No.: 10/053,320

(22) Filed: Jan. 23, 2002

(51) Int. Cl.[7] ..... A61H 15/00; A61H 7/00

(52) U.S. Cl. ..... 601/115; 601/118; 601/127; 601/134

(58) Field of Search ..... 601/69, 70, 84, 601/89–94, 97, 90, 100–104, 115, 116, 122, 126, 118, 127, 134; A61H 7/00, 15/00

(56) References Cited

U.S. PATENT DOCUMENTS 3,853,121 A * 12/1974 Mizrachy et al. ..... 601/48
4,202,326 A * 5/1980 Van Gerpen ..... 601/99
5,674,185 A * 10/1997 Chang ..... 601/122
5,755,677 A * 5/1998 Masuda et al. ..... 601/99
6,196,984 B1 * 3/2001 Hashimoto ..... 601/122

FOREIGN PATENT DOCUMENTS

JP 2002248143 A * 9/2002 ..... A61H/7/00

* cited by examiner

*Primary Examiner*—Nicholas D. Lucchesi
*Assistant Examiner*—Quang D Thanh
(74) *Attorney, Agent, or Firm*—Harrison & Egbert

(57) ABSTRACT

A massaging device is designed for use in conjunction with a leg frame of the massaging chair. The massaging device includes a plurality of clamp boards and massaging wheels. The clamp boards are mounted slantingly to effect a tilting motion for massaging the shank of leg and the sole of foot. The massaging wheels are eccentrically mounted to bring about an eccentric motion for rubbing the shank of leg and the sole of foot.

4 Claims, 6 Drawing Sheets

MASSAGING DEVICE

BACKGROUND OF THE INVENTION

1. Field of the Invention

The present invention relates generally to a physical fitness device, and more particularly to a massaging device for soothing the legs and feet of a person.

2. Description of Related Art

The conventional massaging devices are generally designed to soothe a person's neck, waist, hips, or legs. As far as the conventional leg-massaging devices are concerned, the massaging effect is brought about the rolling motion or vibration of the rollers. The massaging effect of the conventional devices is not as good as expected.

BRIEF SUMMARY OF THE INVENTION

The primary objective of the present invention is to provide a massaging mechanism capable of effective massage of a person's legs.

In keeping with the principle of the present invention, the foregoing objective of the present invention is attained by a massaging device comprising a plurality of clamp board sets and massaging wheel sets, which are driven by a motor to bring about a tilting motion and an eccentric motion for rubbing a person's legs, so as to stimulate circulation and make the leg muscles supple.

The features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
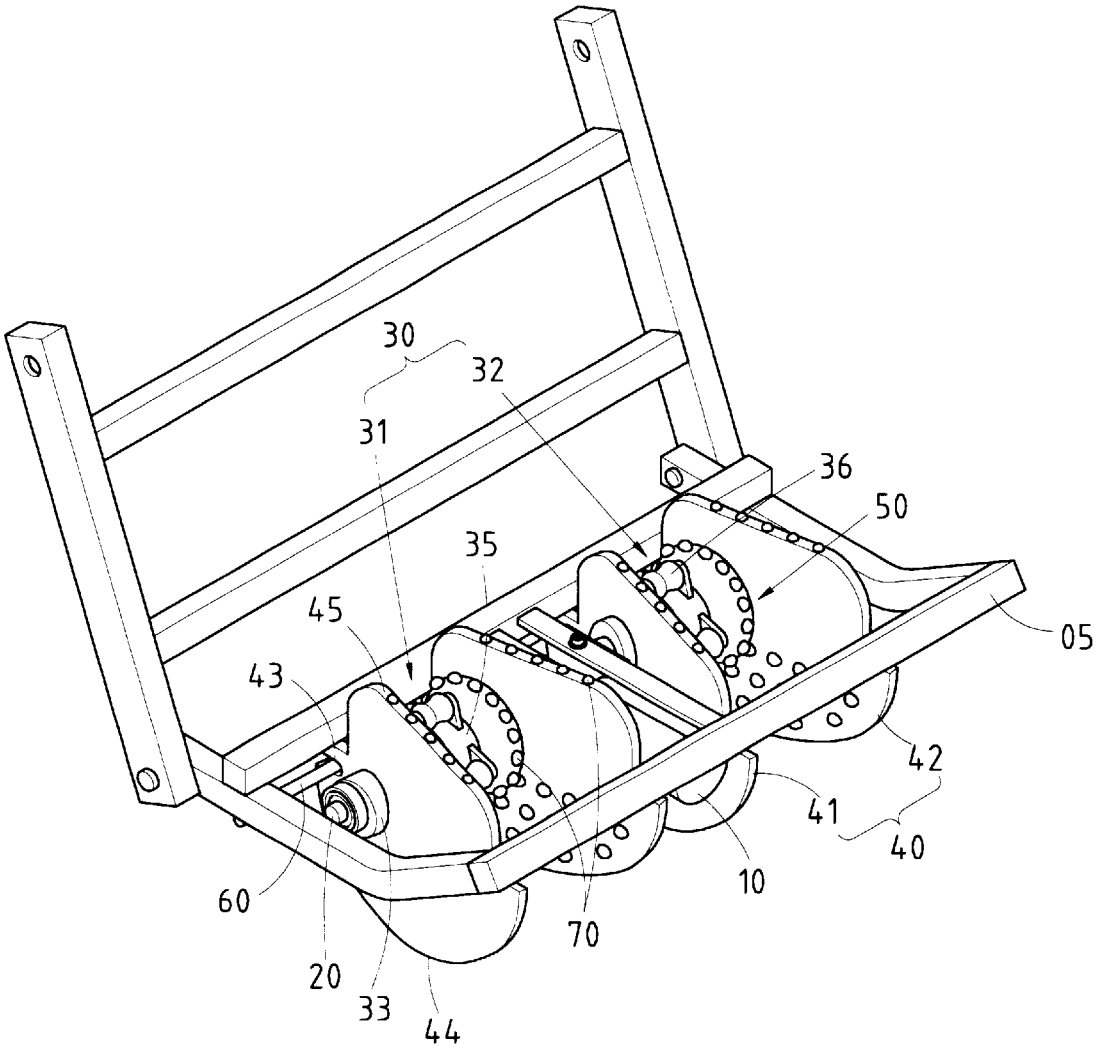
FIG. 1 shows a perspective view of the preferred embodiment of the present invention.
Figure 2:
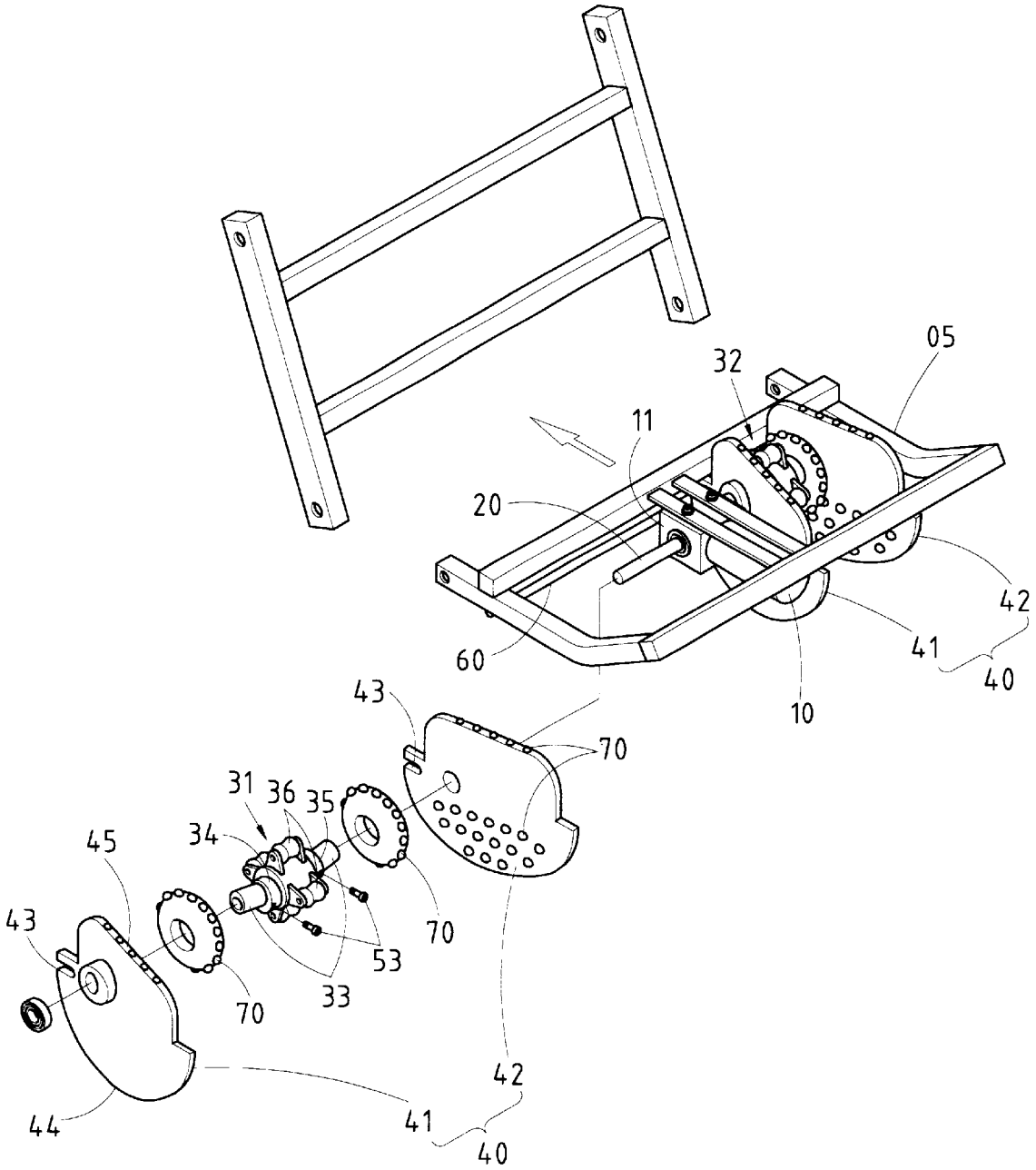
FIG. 2 shows an.exploded view of the preferred embodiment of the present invention.

As shown in FIGS. 1 and 2, a massaging device embodied in the present invention is shown to be mounted on a leg frame 05 of the massaging chair. The massaging device of the present invention comprises a drive motor 10, a transmission shaft 20, a plurality of sleeve sets 30, a plurality of clamp board sets 40, a plurality of massaging wheel sets 50, and an auxiliary guide rod 60.

The drive motor 10 is mounted in the center of the leg frame 05 and is provided on an output shaft thereof with a steering gear set 11.

The transmission shaft 20 is actuated by the steering gear set 11 of the motor 10 and is axially perpendicular to the output shaft of the motor 10.

The sleeve sets 30 are securely mounted on two ends of the transmission shaft 20 and are formed of a first sleeve 31 and a second sleeve 32, which have at least an inclined fitting portion 33, a first eccentric fitting portion 34, a second eccentric fitting portion 35, and a roller area 36 located between the first eccentric fitting portion 34 and the second eccentric fitting portion 35.

The clamp board sets 40 are corresponding in number to the sleeves 31 and 32 and are formed of a first clamp board 41 and a second clamp board 42, which are pivoted respectively to the first sleeve 31 and the second sleeve 32 of two ends of the inclined fitting portion 33.

The massaging wheel sets 50 are corresponding in number to the first sleeve 31 and the second sleeve 32 and are formed of a first massaging wheel 51 and a second massaging wheel 52, which are pivotally mounted on the first eccentric fitting portion 34 and the second eccentric fitting portion 35 in conjunction with a locating bolt 53.

The auxiliary guide rod 60 is mounted on the leg frame 05 such that the auxiliary guide rod 60 is located at one side of the clamp boards 41 and 42, and that the auxiliary guide rod 60 is received in a guide slot 43 of the two clamp boards 41 and 42.

The first clamp board 41 and the second clamp board 42 are provided with an arcuate side 44 and a straight side 45 opposite in location to the arcuate side 44, so as to facilitate the rubbing of the shanks or soles of legs.

Figure 3:
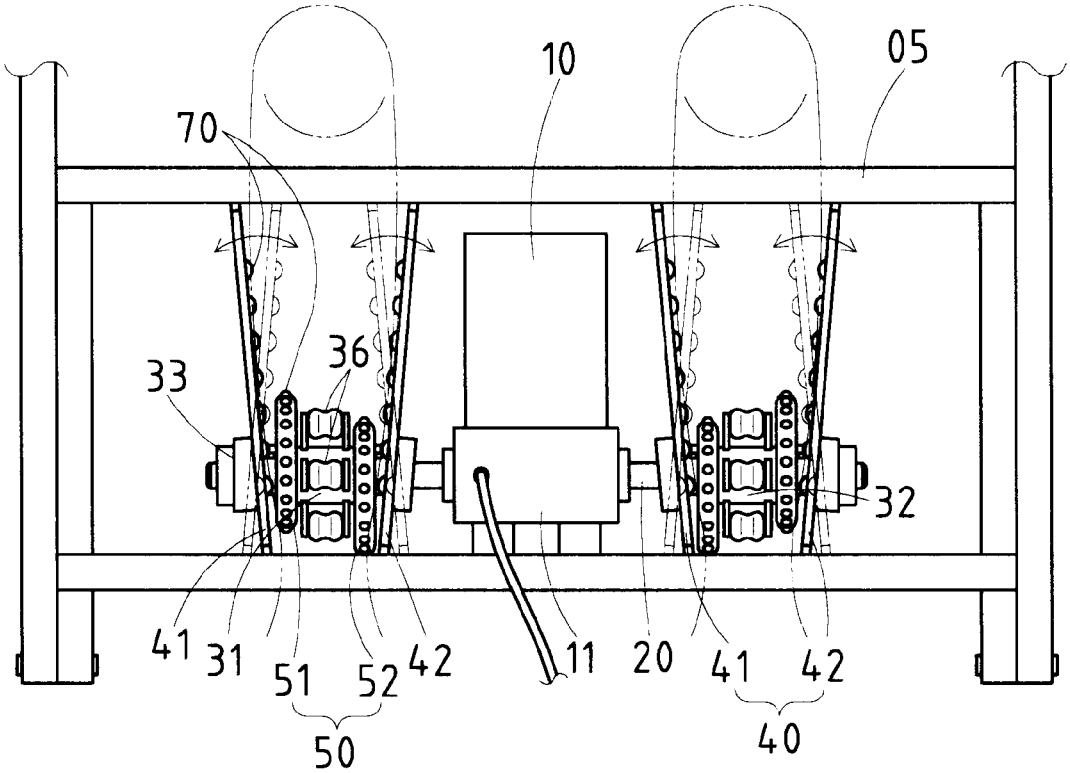
FIG. 3 shows a front view of the preferred embodiment of the present invention in action.
Figure 4:
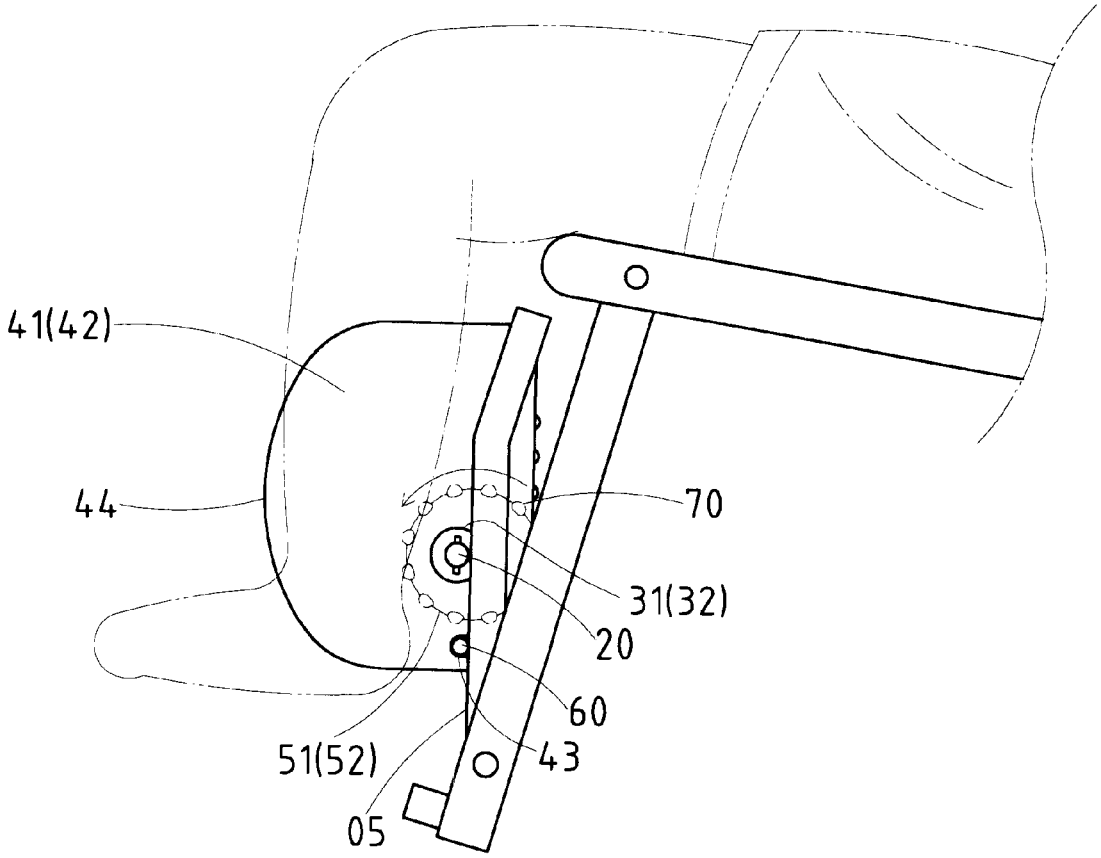
FIG. 4 shows a side view of the preferred embodiment of the present invention at work.

The first massaging wheel 51 and the second massaging wheel 52 are provided in the rim thereof with a plurality of massaging knobs 70. The first clamp board 41 and the second clamp board 42 are provided in the inner surface thereof with a plurality of massaging knobs 70. The massaging knobs 70 of the massaging wheels 51 and 52, and the massaging knobs 70 of the clamp boards 41 and 42 work together to rub the shanks of legs, as shown in FIGS. 3 and 4. When the shanks are to be massaged, the leg frame 05 is turned upwards to remain in the folding state.

Figure 5:
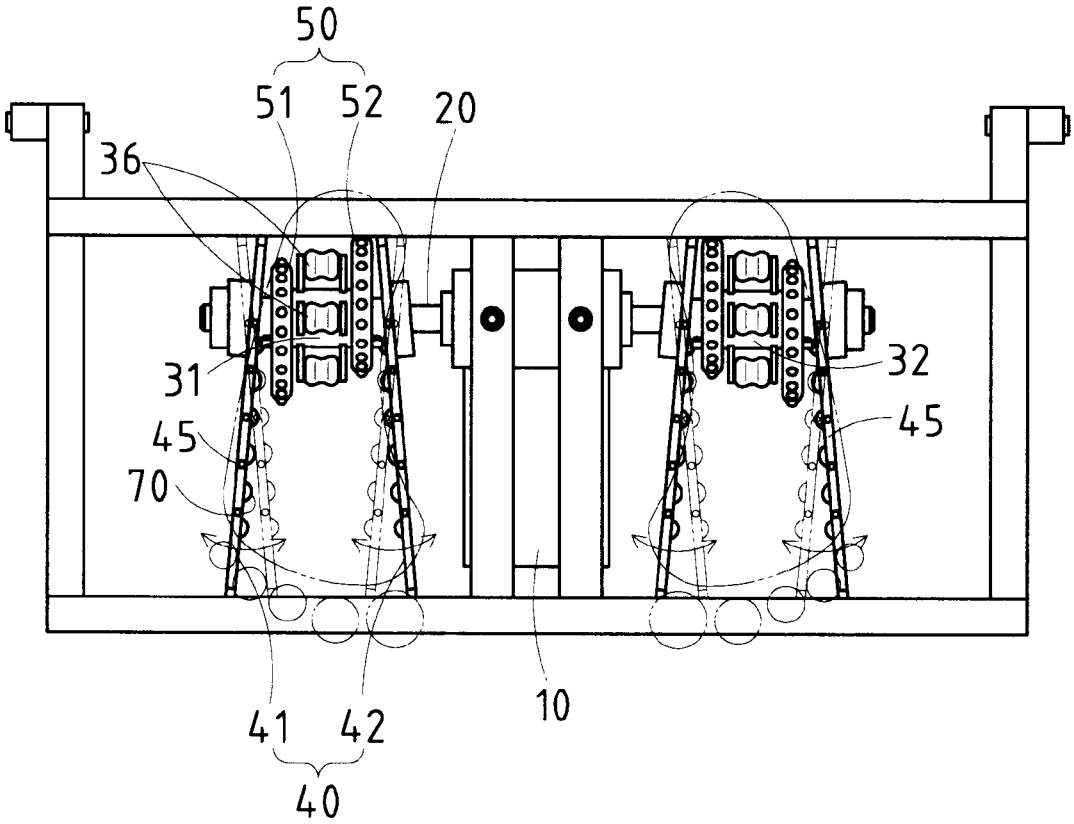
FIG. 5 shows a top view of the preferred embodiment of the present invention in motion.
Figure 6:
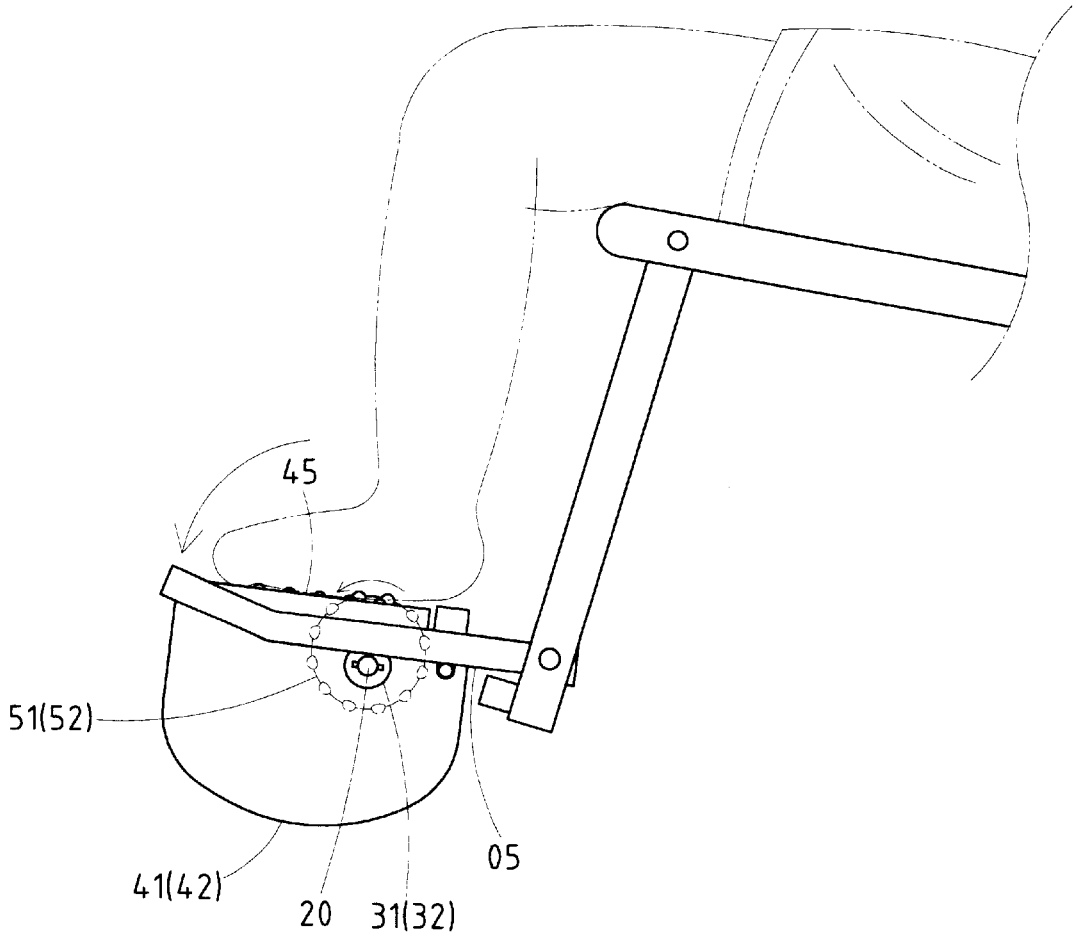
FIG. 6 shows a side schematic view of the preferred embodiment of the present invention at work.

The straight sides 45 of the first clamp board 41 and the second clamp board 42 are provided with a plurality of massaging knobs 70. When the soles of feet are to be massaged, the leg frame 05 is kept in the unfolded state so as to enable the massaging knobs 70 of the straight sides 45 of the clamp boards 41 and 42, and the massaging knobs 70 of the massaging wheels 51 and 52 to work together to rub the soles, as illustrated in FIGS. 5 and 6.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claims.

I claim:

1. A massaging device for massaging a person's legs and feet, said massaging device comprising:

a massaging chair having a leg frame;

a drive motor mounted in the center of the leg frame and provided on an output shaft thereof with a steering gear set;

a transmission shaft fastened to and actuated by said steering gear set of said motor output shaft, said transmission shaft being perpendicular to said motor output shaft;

a plurality of sleeve sets, each being mounted on said transmission shaft and comprised of a first sleeve and a second sleeve whereby said first sleeve and said second sleeve are comprised of an inclined fitting portion, a first eccentric portion, and a second eccentric portion;

a plurality of clamp board sets, each being comprised of a first clamp board and a second clamp board whereby said first clamp board and said second clamp board are pivotally fastened to said inclined fitting portion to effect a tilting motion for rubbing a shank of a leg which is held between said first clamp board and said second clamp board;

a plurality of massaging wheel sets, each being comprised of a first massaging wheel and a second massaging wheel, with said first massaging wheel being mounted on said first eccentric portion to effect an eccentric motion for rubbing the shank of a leg, or a sole of a foot; and an auxiliary guide rod mounted on the leg frame of the massaging chair such that said auxiliary guide rod is received in a guide slot of said first clamp board and said second clamp board of said clamp board sets.

2. The massaging device as defined in claim 1, wherein said first clamp board and said second clamp board of said clamp board sets are comprised of an arcuate side and a straight side opposite to said arcuate side, said arcuate sides serving to massage the shanks of legs in conjunction with said first and said second massaging wheels, said straight sides serving to massage the soles of feet in conjunction with said first and said second massaging wheels.

3. The massaging device as defined in claim 1, wherein said first clamp board and said second clamp board of said clamp board sets are provided in an inner surface thereof with a plurality of massaging knobs; wherein said first massaging wheel and said second massaging wheel of said massaging wheel sets are provided in a rim thereof with a plurality of massaging knobs.

4. The massaging device as defined in claim 2, wherein said arcuate sides of said first clamp board and said second clamp board are provided in an inner surface thereof with a plurality of massaging knobs; wherein said straight sides of said first clamp board and said second clamp board are provided with a plurality of massaging knobs; wherein said first and said second massaging wheels are provided in a rim thereof with a plurality of massaging knobs.

* * * * *